US011607729B2

(12) United States Patent
Kondoh et al.

(10) Patent No.: US 11,607,729 B2
(45) Date of Patent: Mar. 21, 2023

(54) ALUMINUM-BASED COMPOSITE MATERIAL AND METHOD FOR PRODUCING THE SAME

(71) Applicant: Yazaki Corporation, Tokyo (JP)

(72) Inventors: Katsuyoshi Kondoh, Osaka (JP); Yasufumi Otsuka, Shizuoka (JP); Satoru Yoshinaga, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 90 days.

(21) Appl. No.: 17/213,547

(22) Filed: Mar. 26, 2021

(65) Prior Publication Data

US 2021/0213527 A1 Jul. 15, 2021

Related U.S. Application Data

(62) Division of application No. 15/335,826, filed on Oct. 27, 2016, now abandoned.

(30) Foreign Application Priority Data

Oct. 30, 2015 (JP) ..... 2015-214005

(51) Int. Cl.
*B22F 7/00* (2006.01)
*C22C 32/00* (2006.01)
(Continued)

(52) U.S. Cl.
CPC ..... *B22F 7/008* (2013.01); *B22F 1/0003* (2013.01); *B22F 3/16* (2013.01); *B22F 9/04* (2013.01);
(Continued)

(58) Field of Classification Search
CPC ..... B22F 7/008; B22F 1/0003; B22F 3/16; B22F 9/04; B22F 2301/052;
(Continued)

(56) References Cited

U.S. PATENT DOCUMENTS 6,245,439 B1 6/2001 Yamada et al.
2012/0267141 A1 10/2012 Kamiyama et al.
(Continued)

FOREIGN PATENT DOCUMENTS

JP 08104575 A 4/1996
JP 4409872 B2 2/2010
(Continued)

OTHER PUBLICATIONS

Simoes, et al., "Influence of dispersion/mixture time on mechanical properties of AI-CNTs nanocomposites," Composite Structures, 126 (2015) pp. 114-122 (published Feb. 27, 2015). (Year: 2015).*
(Continued)

*Primary Examiner* — John A Hevey
(74) *Attorney, Agent, or Firm* — Sughrue Mion, PLLC

(57) ABSTRACT

An aluminum-based composite material includes a plurality of coarse crystalline grains (3) of pure aluminum, and a plurality of fine crystalline grains (4) each having an aluminum matrix (1), and a dispersion material (2) dispersed inside the aluminum matrix and formed by reacting a portion or all of an additive with aluminum in the aluminum matrix. The fine crystalline grains exist among the coarse crystalline grains, and the fine crystalline grains have crystalline grain diameters smaller than crystalline grain diameters of the coarse crystalline grains.

5 Claims, 4 Drawing Sheets

(51) Int. Cl.

| | |
|---|---|
| ***C22C 1/10*** | (2023.01) |
| ***C22C 1/04*** | (2023.01) |
| ***B22F 1/00*** | (2022.01) |
| ***B22F 3/16*** | (2006.01) |
| ***B22F 9/04*** | (2006.01) |
| ***C22C 26/00*** | (2006.01) |

(52) U.S. Cl.
CPC ..... *C22C 1/0416* (2013.01); *C22C 1/1084* (2013.01); *C22C 26/00* (2013.01); *C22C 32/0047* (2013.01); *C22C 32/0057* (2013.01); *C22C 32/0084* (2013.01); *B22F 2301/052* (2013.01); *B22F 2302/10* (2013.01); *B22F 2302/20* (2013.01); *B22F 2302/403* (2013.01); *B22F 2998/10* (2013.01); *C22C 2026/002* (2013.01); *C22C 2026/006* (2013.01); *C22C 2026/007* (2013.01)

(58) Field of Classification Search
CPC ..... B22F 2302/10; B22F 2302/20; B22F 2302/403; B22F 2998/10; C22C 1/0416; C22C 1/1084; C22C 26/00; C22C 32/0047; C22C 32/0057; C22C 32/0084; C22C 2026/002; C22C 2026/006; C22C 2026/007
See application file for complete search history.

(56) References Cited

U.S. PATENT DOCUMENTS

| | | | | |
|---|---|---|---|---|
| 2014/0225042 | A1* | 8/2014 | In | C22C 23/00 252/503 |
| 2016/0101468 | A1 | 4/2016 | An et al. | |
| 2017/0073797 | A1 | 3/2017 | Otsuka et al. | |

FOREIGN PATENT DOCUMENTS

| | | | |
|---|---|---|---|
| JP | 2010261088 | A | 11/2010 |
| JP | 2011-171291 | A | 9/2011 |
| JP | 2015227498 | A | 12/2015 |
| WO | 2013/002272 | A1 | 1/2013 |
| WO | 2013/085003 | A1 | 6/2013 |

OTHER PUBLICATIONS

Communication dated Jan. 16, 2018 from the Japanese Patent Office in counterpart Japanese application No. 2015-214005.
Ye, J., Han, B., Lee, Z., Ahn, B., Nutt, S. and Schoenung, J. (2005). A tri-modal aluminum based composite with super-high strength. Scripta Materialia, 53(5), pp. 481-486. (Year: 2005).
B4C Nanoparticles <https://www.nanoparticles-microspheres.com/Products/Boron-Carbide-Nanoparticles.html 2012 (Year: 2012).

* cited by examiner

ALUMINUM-BASED COMPOSITE MATERIAL AND METHOD FOR PRODUCING THE SAME

CROSS REFERENCE TO RELATED APPLICATIONS

This application is a Divisional Application of U.S. patent application Ser. No. 15/335,826, filed Oct. 27, 2016, which claims the priority of Japanese Patent Application No. 2015-214005, filed on Oct. 30, 2015, the entire contents of which are incorporated herein by reference.

BACKGROUND

Technical Field

The present invention relates to an aluminum-based composite material and a method for producing the aluminum-based composite material. Specifically, the present invention relates to an aluminum-based composite material which achieves improvements in the strength and the elongation while retaining the electrical conductivity, and to a method for producing the aluminum-based composite material.

Related Art

Copper has been used as a main conductor material of an electrical wire used in an automotive wire harness and so forth. Meanwhile, aluminum has also attracted attention due to the demand for reducing the weight of such conductors. Although copper is excellent in terms of tensile strength and electrical conductivity, the copper has a problem that the weight is heavy. In contrast, aluminum is light in weight, but has a problem of insufficient strength. Accordingly, studies have been conducted, seeking for the method for improving the electrical conductivity and the strength by combining aluminum with other materials.

Heretofore, an aluminum alloy-based composite material has been proposed whose strength and electrical conductivity are improved by incorporating metal- or ceramic-coated carbon nanotubes (CNTs) into an aluminum alloy matrix (see Japanese Patent No. 4409872). Further, a wire rod containing CNTs dispersed in an aluminum material has been proposed. The wire rod has a cellulation structure including a wall portion containing the CNTs, and an inside portion of the wall which is surrounded by the wall portion and made of the aluminum material and unavoidable impurities (see Japanese Patent Application Publication No. 2011-171291). Furthermore, a composite conductor has been proposed which includes: an internal layer having crystalline grains of aluminum or an aluminum-based alloy, and a nanoparticle existing in a grain boundary between the crystalline grains; and an external layer coating the internal layer and having crystalline grains of copper or a copper-based alloy (see International Publication No. WO2013/085003).

SUMMARY

However, in Japanese Patent No. 4409872, the carbon nanotubes are not reacted with the metal matrix. This brings about the following problems. Specifically, air bubbles existing inside the carbon-nanotube aggregate serve as defects, decreasing the elongation and the electrical conductivity. In addition, the strength is also lowered due to an insufficient binding force between the carbon nanotubes and the metal matrix. Meanwhile, if carbon nanotubes are dispersed to such an extent that a cellulation structure is formed as in Japanese Patent Application Publication No. 2011-171291, the strength is improved insufficiently. Further, in International Publication No. WO2013/085003, since aluminum of the internal layer is in contact with copper of the external layer, galvanic corrosion occurs during a long period of use. This may consequently decrease the strength, the elongation, and the electrical conductivity.

Meanwhile, production of an aluminum alloy is a well-known approach of increasing the strength of aluminum. However, in improving the strength by producing an aluminum alloy, the solid solution elements may decrease the electrical conductivity and the elongation.

The present invention has been made in view of such problems of the conventional techniques. An object of the present invention is to provide: an aluminum-based composite material which achieves an improvement in at least one of the strength and the elongation while retaining the electrical conductivity: and a method for producing the aluminum-based composite material.

An aluminum-based composite material according to a first aspect of the present invention includes a plurality of coarse crystal grains of pure aluminum. The aluminum-based composite material further includes a plurality of fine crystal grains each having an aluminum matrix, and a dispersion material dispersed inside the aluminum matrix and formed by reacting a portion or all of an additive with aluminum in the aluminum matrix. The fine crystal grains exist among the coarse crystal grains, and the fine crystal grains have crystal grain diameters smaller than crystal grain diameters of the coarse crystal grains.

The additive may be at least one selected from the group consisting of carbon nanotubes, carbon nanohorns, carbon blacks, boron carbides, and boron nitrides.

A ratio of a long axis to a short axis (long axis/short axis) of the dispersion material may be 1 to 30, the long axis may range from 0.01 nm to 500 nm, and the short axis may range from 0.01 nm to 200 nm.

An aluminum-based composite material according to a second aspect of the present invention includes a plurality of coarse crystalline grains each having an aluminum matrix, and a dispersion material dispersed inside the aluminum matrix and formed by reacting a portion or all of an additive with aluminum in the aluminum matrix. The aluminum-based composite material further includes a plurality of fine crystalline grains each having an aluminum matrix, and a dispersion material dispersed inside the aluminum matrix and formed by reacting a portion or all of an additive with aluminum in the aluminum matrix. At least one of a purity of aluminum constituting the aluminum matrix and a content of the additive in the fine crystalline grains is different from that in the coarse crystalline grains. The fine crystalline grains exist among the coarse crystalline grains, and the fine crystalline grains have crystalline grain diameters smaller than crystalline grain diameters of the coarse crystalline grains.

The additive may be at least one selected from the group consisting of carbon nanotubes, carbon nanohorns, carbon blacks, boron carbides, and boron nitrides.

A ratio of a long axis to a short axis (long axis/short axis) of the dispersion material may be 1 to 30, the long axis may range from 0.01 nm to 500 nm, and the short axis may range from 0.01 nm to 200 nm.

A method according to a third aspect of the present invention is a method for producing the aluminum-based composite material in accordance with the first aspect of the present invention. The method includes mixing an aluminum powder having a purity of 99% by mass or more with at least one additive selected from the group consisting of carbon nanotubes, carbon nanohorns, carbon blacks, boron carbides, and boron nitrides to obtain a fine crystalline grain precursor. The fine crystalline grain precursor is mixed with a coarse crystalline grain precursor made of pure aluminum, and is compacted to obtain a compact. The compact is heated at a temperature of 600 to 660° C.

In the aluminum-based composite materials according to the aspects of the present invention, the dispersion material is highly dispersed inside the aluminum matrix of the fine crystalline grains. This makes is possible to form fine aluminum crystalline grains and enhance the strength of the aluminum-based composite materials. In addition, since the aluminum-based composite materials contain the coarse crystalline grains, this makes it possible to enhance at least one of the elongation and the electrical conductivity of the resulting aluminum-based composite material.

DETAILED DESCRIPTION

Figure 1A:
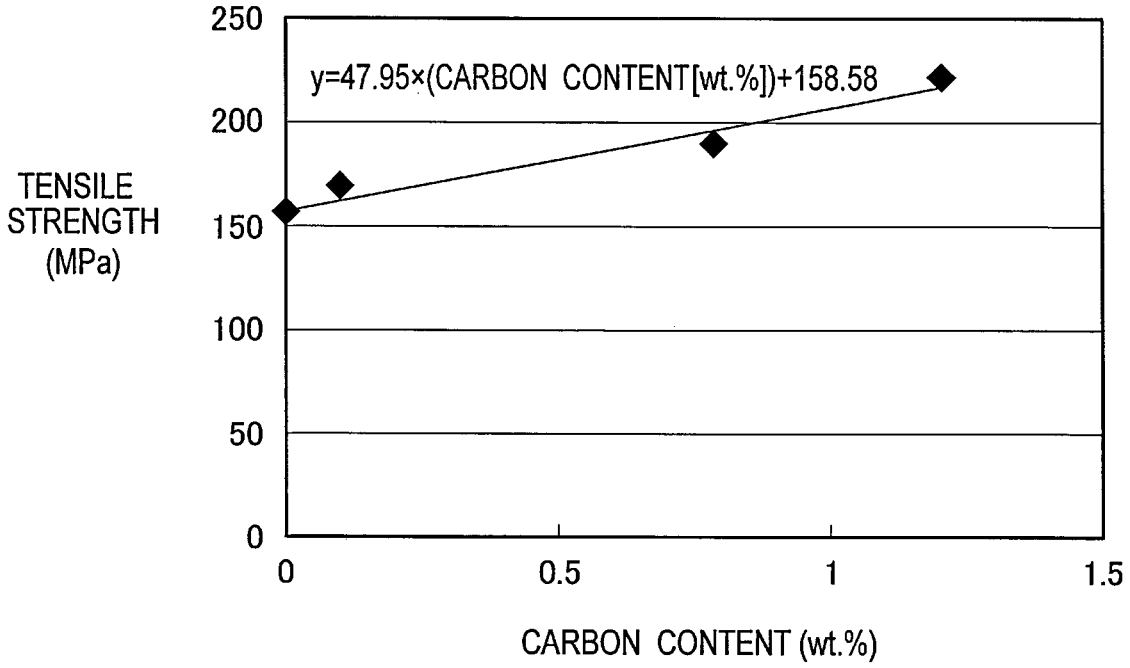
FIG. 1A is a graph for illustrating a relation between the carbon content and the tensile strength of an aluminum-based composite material according to a first embodiment.

Hereinafter, aluminum-based composite materials and methods for producing the aluminum-based composite materials according to embodiments of the present invention will be described in detail using the drawings.

First Embodiment (Aluminum-Based Composite Material)

An aluminum-based composite material according to a first embodiment includes: multiple coarse crystalline grains of pure aluminum; and multiple fine crystalline grains existing among the coarse crystalline grains and having crystalline grain diameters smaller than those of the coarse crystalline grains.

The coarse crystalline grains are particles made of pure aluminum. Specifically, the coarse crystalline grains are preferably made of aluminum having a purity of 99% by mass or more. It is also preferable to use coarse crystalline grains having a purity equal to or higher than that of a class-1 aluminum ingot among pure aluminum ingots specified in Japanese Industrial Standards JIS H2102 (aluminum ingot). Specific examples thereof include a class-1 aluminum ingot having a purity of 99.7% by mass or more, a special class-2 aluminum ingot having a purity of 99.85% by mass or more, and a special class-1 aluminum ingot having a purity of 99.90% by mass or more. In other words, as the coarse crystalline grains of the present embodiment, it is possible to use not only expensive high-purity aluminum ingots such as special class-1 and special class-2, but also aluminum ingots having a purity of 99.7% by mass or more available at reasonable prices. The use of such aluminum as the coarse crystalline grains makes it possible to enhance the electric conductivity of the resulting aluminum-based composite material.

Moreover, the coarse crystalline grains may contain the raw material and unavoidable impurities mixed during the production process. Examples of the unavoidable impurities which may possibly be incorporated into the coarse crystalline grains include zinc (Zn), nickel (Ni), manganese (Mn), rubidium (Rb), chromium (Cr), titanium (Ti), tin (Sn), vanadium (V), gallium (Ga), boron (B), sodium (Na), and the like. These are inevitably incorporated in such a range that the effects of the present embodiment are not inhibited, and also that the properties of the aluminum-based composite material of the present embodiment are not particularly influenced. Note that the element already contained in the aluminum ingot to be used is also included in the unavoidable impurities herein. A total amount of the unavoidable impurities in the aluminum-based composite material is preferably 0.07% by mass or less, more preferably 0.05% by mass or less.

Further, the aluminum-based composite material of the present embodiment includes the fine crystalline grains existing among the coarse crystalline grains. Moreover, the fine crystalline grains each have an aluminum matrix, and a dispersion material dispersed inside the aluminum matrix and formed by reacting a portion or all of an additive with aluminum in the aluminum matrix.

Here, a pure aluminum material prepared by a conventional melting method has a tensile strength of only 70 MPa or so. Further, even if carbon is added to enhance the strength, the poor wettability of carbon with aluminum makes it difficult to uniformly disperse carbon in aluminum. In contrast, the aluminum-based composite material of the present embodiment contains, in addition to the above-described coarse crystalline grains, the fine crystalline grains which are fine aluminum crystalline grains, and in which the dispersion material is highly dispersed inside the aluminum matrix. Containing the fine crystalline grains with fine and uniform aluminum solidified structures in this manner makes it possible to enhance the strength and the toughness of the resulting aluminum-based composite material.

As the aluminum matrix of the fine crystalline grains, it is preferable to use aluminum having a purity of 99% by mass or more as in the case of the coarse crystalline grains. It is also preferable to use an aluminum matrix having a purity equal to or higher than that of a class-1 aluminum ingot among pure aluminum ingots specified in JIS H2102. Specific examples thereof include a class-1 aluminum ingot having a purity of 99.7% by mass or more, a special class-2 aluminum ingot having a purity of 99.85% by mass or more, and a special class-1 aluminum ingot having a purity of 99.90% by mass or more. The use of such aluminum as the aluminum matrix makes it possible to enhance the electric conductivity of the resulting aluminum-based composite material as in the case of the coarse crystalline grains.

Note that, as in the case of the coarse crystalline grains, the aluminum matrix may contain the raw material and unavoidable impurities mixed during the production process. A total amount of the unavoidable impurities in the aluminum-based composite material is preferably 0.07% by mass or less, more preferably 0.05% by mass or less.

In the fine crystalline grains of the present embodiment, the dispersion material formed by reacting aluminum with the additive is highly dispersed inside the aluminum matrix. Specifically, the dispersion material is formed by sintering, so that the additive is bonded to aluminum in the aluminum matrix. Such an additive is preferably at least one selected from the group consisting of carbon nanotubes, carbon nanohorns, carbon blacks, boron carbides ($B_4C$), and boron nitrides (BN). Such an additive readily reacts with aluminum, making it possible to form the fine aluminum crystalline grains.

The shape of the dispersion material dispersed in the aluminum matrix is not particularly limited, but the dispersion material preferably has a rod shape or a needle shape. A rod-shaped or needle-shaped dispersion material makes it possible to improve the dispersibility inside the aluminum matrix and the crystalline grain fineness of the fine crystalline grains. Note that in the case where the dispersion material has a rod shape or a needle shape, the ratio of a long axis (L) to a short axis (D) thereof is preferably such that the long axis (L)/the short axis (D)=1 to 30. In addition, the long axis (L) preferably ranges from 0.01 nm to 500 nm, and the short axis (D) preferably ranges from 0.01 nm to 200 nm. Note that the long axis and the short axis of the dispersion material can be measured by observing a cross section of the aluminum-based composite material using a transmission electron microscope.

More preferably, in the fine crystalline grains of the present embodiment, a rod-shaped or needle-shaped dispersion material made of aluminum carbide ($Al_4C_3$) is highly dispersed inside the aluminum matrix. Note that this aluminum carbide is formed by sintering, so that the rod-shaped or needle-shaped carbon material reacts with aluminum in the aluminum matrix. As such a carbon material, it is possible to use at least one selected from the group consisting of carbon nanotubes, carbon nanohorns, and carbon nanofibers. Among these, carbon nanotubes are particularly preferable.

Known carbon nanotubes can be used as the carbon nanotubes. The carbon nanotubes have short axes ranging from, for example, 0.4 nm to 50 nm, and the carbon nanotubes have an average long axis of, for example, 1 μm or more. The carbon nanotubes may be washed with an acid in advance to remove amorphous carbon and a metal catalyst such as platinum, or may be treated at high temperature in advance for the graphitization. Subjecting the carbon nanotube to such a pretreatment(s) makes the carbon nanotube have a high purity or a high degree of crystallization.

The rod-shaped or needle-shaped aluminum carbide dispersed in the aluminum matrix is formed by reacting the above-described carbon material with aluminum in the aluminum matrix. Here, a portion or all of the carbon material such as carbon nanotubes reacts with aluminum in the aluminum matrix. Specifically, in the present embodiment, it is most preferable that all of the additive serving as the carbon material react with aluminum in the aluminum matrix, so that the composition changes into aluminum carbide. However, for example, in the case where a portion of the carbon nanotubes aggregating into a spherical shape remains in the aluminum matrix, a carbon nanotube inside the aggregate is not in contact with the aluminum matrix, and accordingly may remain in the form of carbon nanotube in the aluminum matrix. Nevertheless, from the viewpoint of improving the strength of the aluminum-based composite material, preferably 95% by mass or more of the additive serving as the carbon material, more preferably 98% by mass or more of the carbon material, reacts with aluminum in the aluminum matrix. Moreover, particularly preferably all of the additive serving as the carbon material reacts with aluminum in the aluminum matrix.

Further, in the aluminum matrix of the fine crystalline grains, the distance between such dispersion materials adjacent to each other is preferably 1 μm or less. When the distance between the dispersion materials is 1 μm or less, this makes it possible to enhance the dispersibility of the dispersion materials inside the aluminum matrix, and form fine aluminum crystalline grains. Note that the distance between the dispersion materials adjacent to each other can be measured by observing a cross section of the aluminum-based composite material using a transmission electron microscope.

Figure 1B:
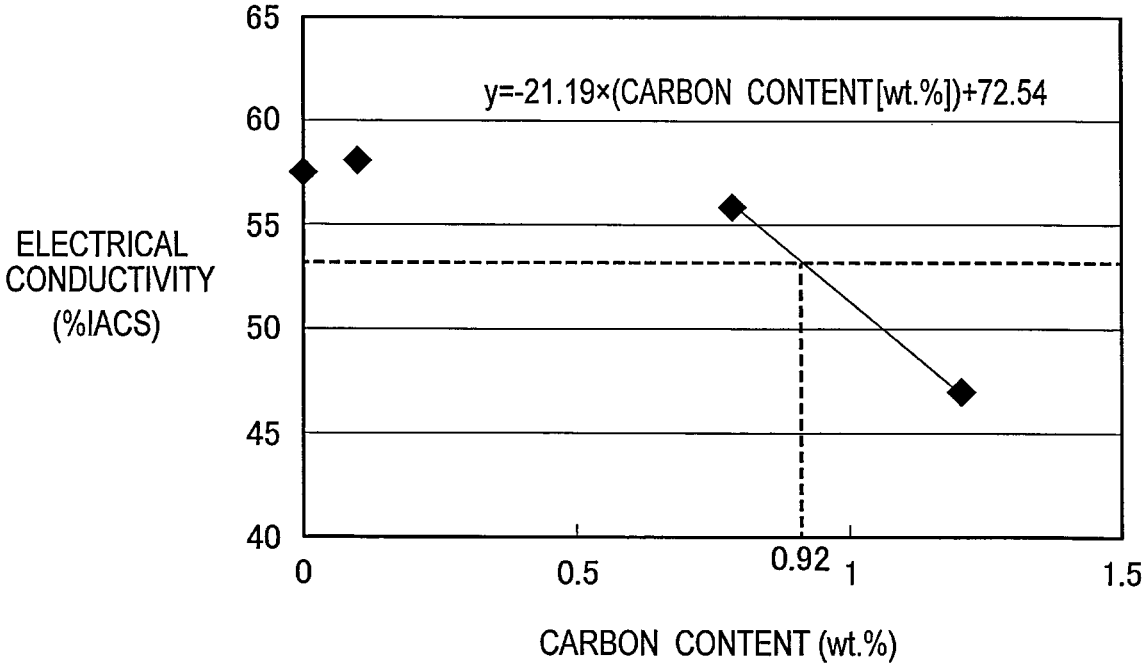
FIG. 1B is a graph for illustrating a relation between the carbon content and the electrical conductivity of the aluminum-based composite material according to the first embodiment.

In the aluminum-based composite material of the present embodiment, a content of the dispersion material is preferably 0.1 to 2.0% by mass in terms of the carbon amount. In other words, in the aluminum-based composite material containing the coarse crystalline grains and the fine crystalline grains, the content of the dispersion material in the fine crystalline grains is preferably 0.1 to 2.0% by mass in terms of the carbon amount. Setting the content of the dispersion material within this range makes it possible to obtain desired tensile strength and electrical conductivity when the aluminum-based composite material is used as an electrical wire. In this respect, FIG. 1A shows a relation between the amount of carbon contained in the aluminum-based composite material of the present embodiment and the tensile strength of the aluminum-based composite material. In addition, FIG. 1B shows a relation between the amount of carbon contained in the aluminum-based composite material and the electrical conductivity of the aluminum-based composite material. As shown in FIGS. 1A and 1B, the dispersion material has a correlation like a linear function with the tensile strength and the electrical conductivity. In other words, increasing the carbon amount in the aluminum-based composite material increases the tensile strength but decreases the electrical conductivity. Further, in the case where the aluminum-based composite material is used as an electrical wire material, the aluminum-based composite material preferably has an electrical conductivity of 30% IACS or more. Hence, based on FIG. 1B, the content of the dispersion material in the aluminum-based composite material is preferably 2.0% by mass or less in terms of the carbon amount.

In the aluminum-based composite material, the coarse crystalline grains need to have crystalline grain diameters larger than the crystalline grain diameters of the fine crystalline grains. Specifically, the coarse crystalline grains preferably have crystalline grain diameters of 1 μm to 5 μm. Setting the crystalline grain diameters of the coarse crystalline grains within this range makes it possible to suppress decreases in the electrical conductivity and the elongation of the resulting aluminum-based composite material. Note that the crystalline grain diameters of the coarse crystalline grains can be determined by an intercept method.

Moreover, in the aluminum-based composite material, the fine crystalline grains need to have crystalline grain diameters smaller than the crystalline grain diameters of the coarse crystalline grains. Specifically, the fine crystalline grains preferably have crystalline grain diameters of less than 1 μm. Forming the fine crystalline grains having crystalline grain diameters as fine as less than 1 μm makes it possible to enhance the strength and the toughness of the aluminum-based composite material. Note that the crystalline grain diameters of the fine crystalline grains can also be determined by an intercept method.

In the aluminum-based composite material, the ratio between the coarse crystalline grains and the fine crystalline grains is not particularly limited. For example, the mass ratio is preferably 1:2 to 1:1 (coarse crystalline grains:fine crystalline grains). Setting the ratio between the coarse crystalline grains and the fine crystalline grains within this range makes it possible to achieve both the suppressions of decreases in the electrical conductivity and the elongation owing to the coarse crystalline grains as well as improvements in the strength and the toughness owing to the fine crystalline grains.

In the present embodiment, the form of the fine crystalline grains is not limited, as long as the fine crystalline grains exist among the adjacent coarse crystalline grains. In other words, the fine crystalline grains may adhere in an aggregate form to outer circumferences of the coarse crystalline grains. Further, the fine crystalline grains may adhere in such a manner as to cover surfaces of the coarse crystalline grains.

Here, forming an aluminum-based composite material made only of fine crystalline grains can greatly improve the tensile strength in comparison with pure aluminum, but there is a problem that the elongation and the electrical conductivity are decreased. In other words, an aluminum-based composite material in which merely a dispersion material is dispersed in an aluminum matrix has a problem that it is difficult to balance the tensile strength, the elongation, and the electrical conductivity at high levels, respectively.

In contrast, the aluminum-based composite material of the present embodiment has a bimodal structure including two regions: a region of the fine crystalline grains where nanoparticles are dispersed as the dispersion material; and a region of the coarse crystalline grains of pure aluminum. This makes it possible to improve the electrical conductivity and the elongation in comparison with an aluminum-based composite material in which merely a dispersion material is dispersed in an aluminum matrix. Specifically, the electrical conductivity is low in the region of the fine crystalline grains where the dispersion material is dispersed; nevertheless, since the content of impurities is low in the region of the coarse crystalline grains of pure aluminum, this increases the electrical conductivity. Accordingly, the composite material as a whole achieves a high level of electrical conductivity owing to the coarse crystalline grains. Meanwhile, an aluminum-based composite material in which merely a dispersion material is dispersed in an aluminum matrix has a low elongation. In contrast, the aluminum-based composite material of the present embodiment having the bimodal structure includes not only the region of the fine crystalline grains but also the region of the coarse crystalline grains of pure aluminum. Accordingly, the high elongation of the coarse crystalline grains makes it possible to enhance the elongation of the composite material as a whole.

The aluminum-based composite material of the present embodiment preferably has a tensile strength of 200 MPa or more and an electrical conductivity of 30% IACS or more. Such an aluminum-based composite material can be suitably used as an electrical wire particularly having a conductor with a cross-sectional area of 0.35 $mm^2$. The aluminum-based composite material of the present embodiment more preferably has a tensile strength of 140 MPa or more and an electrical conductivity of 53% IACS or more. Such an aluminum-based composite material can be suitably used as an electrical wire particularly having a conductor with a cross-sectional area of 0.5 $mm^2$. The aluminum-based composite material of the present embodiment furthermore preferably has a tensile strength of 94 MPa or more and an electrical conductivity of 58% IACS or more. Such an aluminum-based composite material can be suitably used as an electrical wire particularly having a conductor with a cross-sectional area of 0.75 $mm^2$. Note that, in the present specification, a value of the tensile strength can be measured in accordance with JIS Z2241 (Metallic materials-Tensile testing Method). Moreover, in the present specification, a value of the electrical conductivity can be measured in accordance with JIS H0505 (Measuring Methods for Electrical Resistivity and Conductivity of Non-Ferrous Materials).

Since the aluminum-based composite material of the present embodiment is high in both electric conductivity and strength as described above, it can be wire-drawn for use as a conductor of an electrical wire. Accordingly, an electrical wire according to the present embodiment should include at least a conductor (for example, a stranded wire) containing a wire made of the above-described aluminum-based composite material, and a coating layer provided on an outer circumference of the conductor. Hence, the other specific configuration and shape as well as the production method are not limited at all.

The shape and the like of the wire constituting the conductor are also not particularly limited. For example, in a case where the wire is a round wire used in an automotive electrical wire, the short axis (i.e., final wire diameter) is preferably approximately 0.07 mm to 1.5 mm, more preferably approximately 0.14 mm to 0.5 mm.

As the type of a resin used in the coating layer, it is possible to use any known insulating resin including olefin resins such as crosslinked polyethylene and polypropylene, vinyl chloride, and the like. The coating thickness is determined as appropriate. The electrical wire can be used in various applications such as electric or electronic components, mechanical components, vehicle components, and building materials. Among these, the electrical wire is preferably usable as an automotive electrical wire.

Note that the electrical wire using the aluminum-based composite material of the present embodiment as a conductor may be subjected to solid-state cold welding together with an electrical wire using a conductor made of another metal material. Moreover, to make easy the connection to an electronic device, a terminal fitting may be crimp-connected to the conductor made of the aluminum-based composite material.

Further, the electrical wire using the aluminum-based composite material of the present embodiment as a conductor is preferably used in a wire harness. As described above, since the electrical wire using the aluminum-based composite material has a high strength and a high electric conductivity at higher levels than the conventional materials, this enables diameter reduction and wider application of the aluminum electrical wire. Thus, the wire harness using such an electrical wire achieves a greater weight reduction than ever, and is also superior in strength, durability, and electric conductivity. Hence, the wire harness can be preferably used as an automotive wire harness.

As described above, the aluminum-based composite material according to the first embodiment has multiple coarse crystalline grains of pure aluminum. Further, the aluminum-based composite material has multiple fine crystalline grains each having an aluminum matrix, and a dispersion material dispersed inside the aluminum matrix and formed by reacting a portion or all of an additive with aluminum in the aluminum matrix. Moreover, the fine crystalline grains exist among the coarse crystalline grains, and the crystalline grain diameters of the fine crystalline grains are smaller than the crystalline grain diameters of the coarse crystalline grains. In this configuration, since the dispersion material is highly dispersed inside the aluminum matrix of the fine crystalline grains, this makes it possible to form fine aluminum crystalline grains, and enhance the strength and the toughness of the aluminum-based composite material to levels equivalent to those of copper. Moreover, containing the coarse crystalline grains of pure aluminum makes it possible to suppress decreases in the elongation and the electrical conductivity of the resulting aluminum-based composite material.

(Method for Producing Aluminum-Based Composite Material)

Figure 2A:
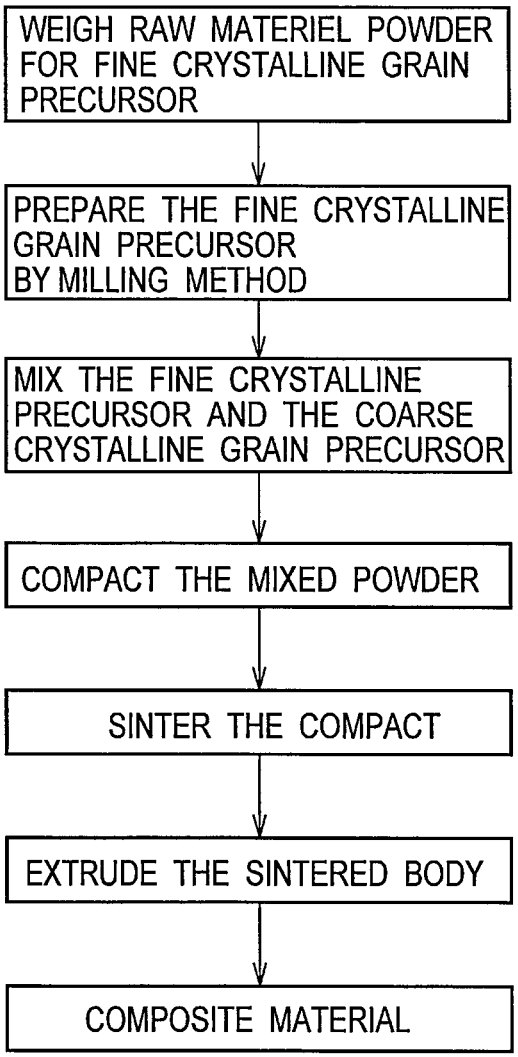
FIG. 2A is a flowchart for illustrating a method for producing the aluminum-based composite material according to the first embodiment.

Next, a method for producing the aluminum-based composite material according to the first embodiment will be described. As shown in FIG. 2A, first, an aluminum powder and an additive, which are raw materials of fine crystalline grains, are weighed. As the aluminum powder, aluminum having a purity of 99% by mass or more is preferably used to enhance the electric conductivity as described above. Moreover, as the additive, a carbon nanotube, a carbon nanohorn, carbon black, boron carbide, or boron nitride is preferably used as described above.

In the weighing step, the aluminum powder and the carbon material are weighed such that the content of the dispersion material in the aluminum-based composite material to be obtained is, for example, 0.1 to 2.0% by mass in terms of the carbon amount.

Then, the aluminum powder and the additive thus weighed are mixed together to prepare a powder mixture as a fine crystalline grain precursor. The method for mixing the aluminum powder with the carbon material is not particularly limited. For example, the mixing can be performed by a dry milling method.

Next, the fine crystalline grain precursor is mixed with a coarse crystalline grain precursor made of pure aluminum. As the coarse crystalline grain precursor, pure aluminum having a purity of 99% by mass or more is preferably used to enhance the electric conductivity as described above. In addition, the coarse crystalline grain precursor is preferably mixed in such an amount that the content of the dispersion material in the aluminum-based composite material to be obtained is, for example, 0.1 to 2.0% by mass in terms of the carbon amount as described above. Note that the method for mixing the fine crystalline grain precursor with the coarse crystalline grain precursor is not particularly limited, either. For example, the mixing can be performed by a dry method.

Next, the mixture of the fine crystalline grain precursor and the coarse crystalline grain precursor is subjected to powder compacting to prepare a compact. In this molding step, the powder mixture is compacted by applying a pressure to thereby prepare a compact. In the molding step, the powder mixture is preferably compacted in such a manner as to minimize the gap between the aluminum powder and the carbon material in the powder mixture.

As the method for applying a pressure to the powder mixture in the compact molding step, a known method can be employed. An example thereof includes a method in which after the powder mixture is introduced into a cylindrical molding container, the powder mixture in the container is pressurized. Moreover, the pressure applied to the powder mixture is not particularly limited, and it is preferable to adjust the pressure as appropriate so that the gap between the fine crystalline grain precursor and the coarse crystalline grain precursor can be minimized. The pressure applied to the powder mixture can be, for example, 600 MPa at which the aluminum powder can be molded favorably. Further, the treatment of applying a pressure to the powder mixture in the molding step can be performed, for example, at normal temperature. Furthermore, the time during which a pressure is applied to the powder mixture in the molding step can be, for example, 5 to 60 seconds.

Next, the obtained compact is sintered, and the additive and aluminum in the fine crystalline grain precursor react with each other. Thereby, a dispersion material is formed inside the aluminum matrix. In the sintering step, since the additive and aluminum need to react with each other to form a dispersion material, the sintering temperature for the compact is set 600° C. or higher. If the sintering temperature is less than 600° C., the reaction between the additive and aluminum does not proceed sufficiently, so that the resulting aluminum-based composite material may have an insufficient strength. Note that the upper limit of the sintering temperature is not particularly limited, but is preferably no more than 660° C., which is the melting temperature of aluminum, and is more preferably no more than 630° C.

The compact sintering time is not particularly limited, and is preferably the time during which the additive reacts with aluminum. Specifically, the compact sintering time is preferably, for example, 0.5 to 5 hours. Moreover, as the compact sintering atmosphere, the sintering needs to be performed in an inert atmosphere such as a vacuum atmosphere in order to suppress oxidations of the additive and aluminum.

Such a sintering step makes it possible to disperse the dispersion material inside the aluminum matrix of the fine crystalline grains, and further obtain an aluminum-based composite material in which the fine crystalline grains exist among coarse crystalline grains. Then, to readily process the obtained aluminum-based composite material into a wire or the like, it is preferable to extrude the sintered body obtained in the sintering step. A wire rod, which is a precursor of the wire, can be obtained by extruding the sintered body.

The method for extruding the sintered body is not particularly limited, and a known method can be employed. An example thereof includes a method in which after the sintered body is introduced into a cylindrical extruder, the sintered body is heated and then extruded. The sintered body is preferably heated to a temperature of 300° C. or higher at which the sintered body can be extruded. A material for a wire rod or the like can be obtained by performing such an extrusion. Then, a conductor of an electrical wire can be obtained, for example, by repeating heating and wire drawing on the wire rod.

Note that, in the obtained conductor, the fine crystalline grains preferably have crystalline grain diameters of less than 1 μm as described above. Forming the fine crystalline grains having crystalline grain diameters as fine as less than 1 μm makes it possible to enhance the strength and the toughness of the conductor.

In the production method of the present embodiment, the aluminum powder in the fine crystalline grain precursor preferably has an average powder diameter (D50) of 0.25 μm or more. Even if the aluminum powder has an average powder diameter of less than 0.25 μm, the strength of the resulting aluminum-based composite material can be enhanced. Nevertheless, if the average powder diameter is less than 0.25 μm, the amount of oxygen in the surface of the aluminum powder is increased and the electrical conductivity is decreased in some cases. In other words, aluminum reacts with oxygen in the air and forms a dense oxide film on the surface, so that the electrical conductivity is decreased in some cases.

Figure 3A:
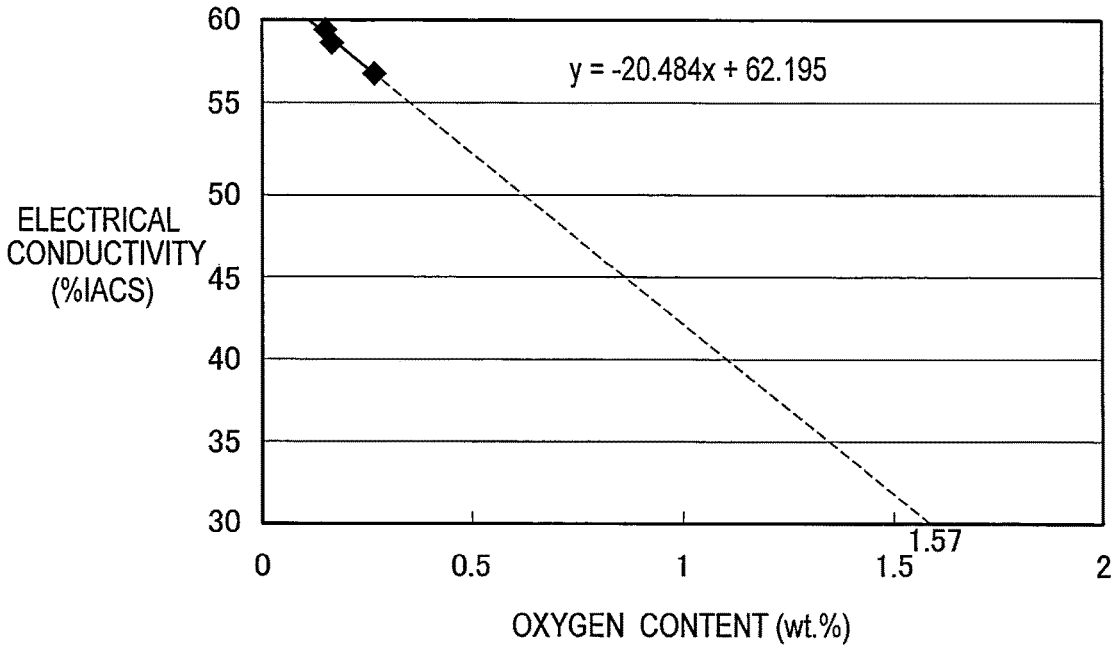
FIG. 3A is a graph for illustrating a relation between the electrical conductivity of aluminum and the amount of oxygen contained in aluminum.
Figure 3B:
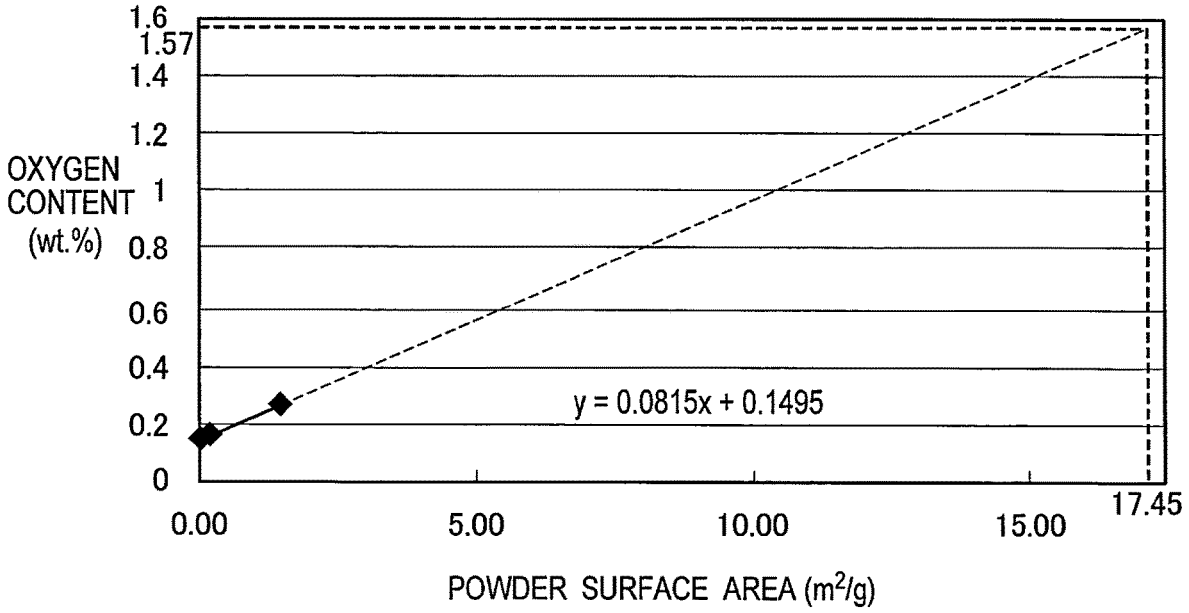
FIG. 3B is a graph for illustrating a relation between the amount of oxygen contained in aluminum and the surface area of an aluminum powder.

FIG. 3A shows a relation between the electrical conductivity of aluminum and the amount of oxygen contained in aluminum. Moreover, FIG. 3B shows a relation between the amount of oxygen contained in aluminum and the surface area of the aluminum powder. As described above, in the case where the aluminum-based composite material is used as an electrical wire material, the electrical conductivity is preferably 30% IACS or more. Hence, based on FIG. 3A, the amount of oxygen contained in aluminum is preferably 1.57% by mass or less. Moreover, based on FIG. 3B, in order that the amount of oxygen contained in aluminum is 1.57% by mass or less, the aluminum powder preferably has a specific surface area of 17.45 $m^2/g$ or less. Hence, in order that the aluminum powder has a specific surface area of 17.45 $m^2/g$ or less, the aluminum powder preferably has an average powder diameter (D50) of 0.25 μm or more.

Note that the upper limit of the average powder diameter of the aluminum powder in the fine crystalline grain precursor is not particularly limited. However, in a case where the shape of the aluminum powder in the fine crystalline grain precursor is substantially spherical, the aluminum powder preferably has an average powder diameter of 5 μm or less. If the average powder diameter exceeds 5 μm, this decreases the specific surface area of the aluminum powder, and hence the dispersibility of the dispersion material is decreased. As a result, the dispersibility of the resulting dispersion material is also decreased, so that it may be difficult to form fine aluminum crystalline grains. Note that the phrase that the shape of the aluminum powder is substantially spherical means the aspect ratio of the aluminum powder is within a range of 1 to 2. Moreover, in the present specification, the term aspect ratio refers to a value representing a particle shape defined by (the longest axis/the width orthogonal to the longest axis) in a microscopic image of the particle.

Nevertheless, in a case where the shape of the aluminum powder in the fine crystalline grain precursor is flat, reducing the thickness of the aluminum powder increases the surface area and makes it possible to improve the dispersibility of the dispersion material on the powder surface. Specifically, processing a spherical powder having a powder diameter of 20 μm into a flat shape with a thickness of 1 μm and a long axis of 72 μm makes the surface area equivalent to that of a spherical powder having a powder diameter of 3 μm. Hence, in the case where the shape of the aluminum powder is simply flat, the upper limit of the average powder diameter of the aluminum powder is not particularly limited. Note that the phrase that the shape of the aluminum powder is flat means the ratio of the longest axis to the thickness of the aluminum powder (the longest axis/the thickness) is within a range of 10 to 100. Moreover, the average powder diameter, the longest axis, the width orthogonal to the longest axis, and the thickness of the aluminum powder can be measured by observation using a scanning electron microscope (SEM).

The method for processing the aluminum powder into a flat shape is not particularly limited, and the processing can be performed by a known method. For example, balls having diameters of 5 to 10 μm, the aluminum powder, and the additive are introduced into a pot of a planetary ball mill and then rotated, so that the flat aluminum powder can be obtained.

The method for producing the aluminum-based composite material of the present embodiment has a step of mixing an aluminum powder having a purity of 99% by mass or more with at least one additive selected from the group consisting of carbon nanotubes, carbon nanohorns, carbon blacks, boron carbides, and boron nitrides to obtain a fine crystalline grain precursor. Further, the production method has steps of: mixing the fine crystalline grain precursor with a coarse crystalline grain precursor made of pure aluminum, followed by powder compacting to obtain a compact; and heating the compact at a temperature of 600 to 660° C.

As in a conventional case, for example, when the structure of a carbon material such as a carbon nanotube is maintained using an aluminum matrix, it is difficult to control the temperature. However, in the production method of the present embodiment, such an additive as a carbon material is reacted with aluminum in the sintering step. This eliminates the need for a complicated temperature control. Moreover, the present embodiment makes use of the dispersion material which is at least one of a carbide and a nitride formed by completely reacting the aluminum matrix with the additive. This eliminates the need for performing a surface modification step such as coating the surface of the dispersion material. Further, the present embodiment includes mixing the fine crystalline grain precursor with the coarse crystalline grain precursor, processing the resultant into a desired shape, and then sintering to form the dispersion material dispersed with a desired dispersibility. This makes it possible to simplify the production process.

Second Embodiment

Next, an aluminum-based composite material according to a second embodiment will be described in detail. Note that the repetitive description for the same configuration as in the first embodiment will be omitted.

As in the first embodiment, the aluminum-based composite material according to the second embodiment includes: multiple coarse crystalline grains; and multiple fine crystalline grains existing among the coarse crystalline grains and having crystalline grain diameters smaller than those of the coarse crystalline grains. Moreover, the fine crystalline grains, as in the first embodiment, each have an aluminum matrix, and a dispersion material dispersed inside the aluminum matrix and formed by reacting a portion or all of an additive with aluminum in the aluminum matrix.

However, in the aluminum-based composite material of the present embodiment, the coarse crystalline grains are not made of pure aluminum but are crystalline grains having the same composition as that of the fine crystalline grains. Specifically, the coarse crystalline grains of the present embodiment each have an aluminum matrix, and a dispersion material dispersed inside the aluminum matrix and formed by reacting a portion or all of an additive with aluminum in the aluminum matrix. Moreover, at least one of the purity of aluminum constituting the aluminum matrix and the content of the additive in the coarse crystalline grains is different from that in the fine crystalline grains.

As described above, in the aluminum-based composite material of the present embodiment, both of the fine crystalline grains and the coarse crystalline grains contain the aluminum matrixes and the dispersion materials. However, the purity of aluminum in the coarse crystalline grains is different from the purity of aluminum in the fine crystalline grains, or the content of the additive in the coarse crystalline grains is different from the content of the additive in the fine crystalline grains. Alternatively, the coarse crystalline grains and the fine crystalline grains are different from each other in both of the aluminum purity and the additive content. In this way, changing the aluminum purity and/or the additive content makes it possible to vary the crystalline grain diameters of the resulting crystalline grains.

Moreover, normally, by increasing the aluminum purity or decreasing the additive content, the resulting crystalline grains are made coarse. Further, the coarse crystalline grains having an increased aluminum purity and a decreased additive content exhibit effects similar to those of the coarse crystalline grains made of pure aluminum of the first embodiment. Thus, even if crystalline grains containing the aluminum matrix and the dispersion material are used as the coarse crystalline grains, it is possible to improve the tensile strength and the electrical conductivity of the resulting aluminum-based composite material as in the first embodiment.

As the aluminum matrix of the coarse crystalline grains in the present embodiment, it is preferable to use aluminum having a purity of 99% by mass or more as in the case of the fine crystalline grains. Moreover, the additive is preferably at least one selected from the group consisting of carbon nanotubes, carbon nanohorns, carbon blacks, boron carbides ($B_4C$), and boron nitrides (BN), as in the case of the fine crystalline grains.

Further, in the coarse crystalline grains of the present embodiment, it is more preferable that a rod-shaped or needle-shaped dispersion material made of aluminum carbide ($Al_4C_3$) be highly dispersed inside the aluminum matrix as in the first embodiment. Furthermore, in the aluminum matrix of the coarse crystalline grains, the distance between such dispersion materials adjacent to each other is preferably 1 μm or less. Additionally, in the aluminum-based composite material of the present embodiment, a content of the dispersion material is preferably 0.1 to 2.0% by mass in terms of the carbon amount.

Note that, as in the first embodiment, in the aluminum-based composite material of the present embodiment, the coarse crystalline grains need to have crystalline grain diameters larger than the crystalline grain diameters of the fine crystalline grains. Specifically, the coarse crystalline grains preferably have crystalline grain diameters of 1 μm to 5 μm. Moreover, the fine crystalline grains preferably have crystalline grain diameters of less than 1 μm.

In the aluminum-based composite material of the present embodiment, the ratio between the coarse crystalline grains and the fine crystalline grains is not particularly limited. Nevertheless, for example, the mass ratio is preferably 1:2 to 1:1 (coarse crystalline grains:fine crystalline grains) as in the first embodiment.

Figure 2B:
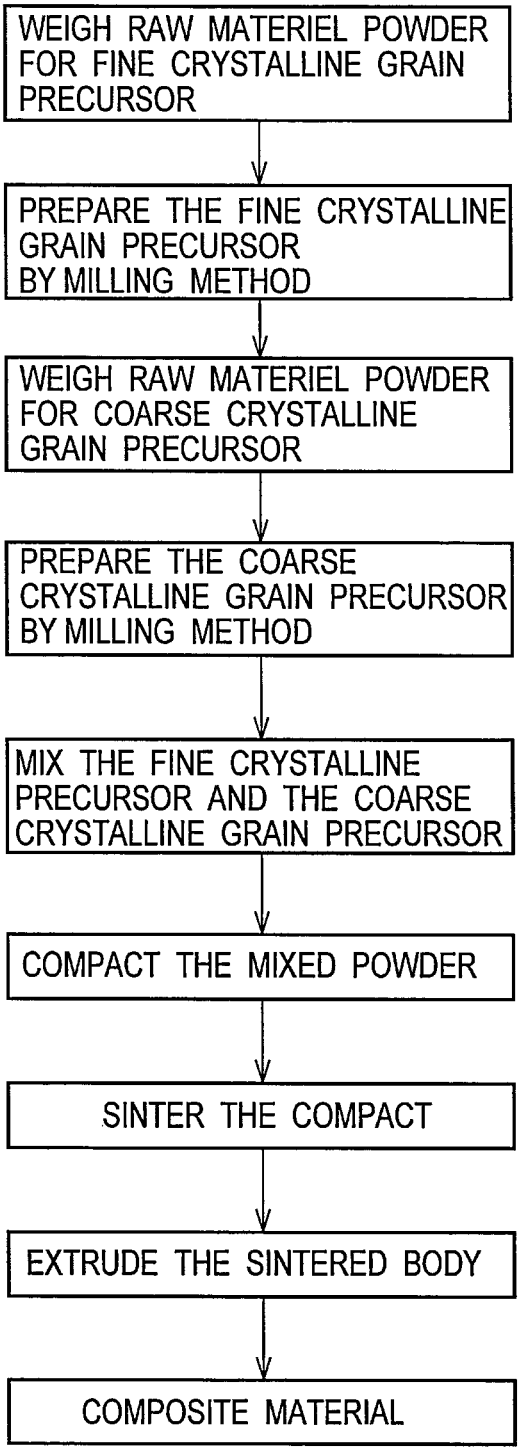
FIG. 2B is a flowchart for illustrating a method for producing an aluminum-based composite material according to a second embodiment.

Next, a method for producing the aluminum-based composite material according to the second embodiment will be described. As shown in FIG. 2B, first, an aluminum powder and an additive, which are raw materials of fine crystalline grains, are weighed. The same aluminum powder and additive as those in the first embodiment can be used.

Then, the aluminum powder and the additive thus weighed are mixed together to prepare a powder mixture as a fine crystalline grain precursor. The method for mixing the aluminum powder with the carbon material is not particularly limited. For example, the mixing can be performed by a dry milling method.

Next, an aluminum powder and an additive, which are raw materials of coarse crystalline grains, are weighed. The same aluminum powder and additive as those of the fine crystalline grains can be used. Then, as in the case of the fine crystalline grains, the aluminum powder and the additive thus weighed are mixed together to prepare a powder mixture as a coarse crystalline grain precursor.

Subsequently, the fine crystalline grain precursor is mixed with the coarse crystalline grain precursor. Note that the method for mixing the fine crystalline grain precursor with the coarse crystalline grain precursor is not particularly limited, either. For example, the mixing can be performed by a dry method.

Further, as in the first embodiment, the mixture of the fine crystalline grain precursor and the coarse crystalline grain precursor is subjected to powder compacting to prepare a compact. Next, the obtained compact is sintered, and the additive and aluminum in the fine crystalline grain precursor react with each other. Furthermore, the additive and aluminum in the coarse crystalline grain precursor react with each other. Thereby, dispersion materials are formed inside the aluminum matrixes.

Thereafter, a wire rod, which is a precursor of a wire, can be obtained by extruding the sintered body obtained in the sintering step. Moreover, a conductor of an electrical wire can be obtained, for example, by repeating heating and wire drawing on the wire rod.

As described above, the aluminum-based composite material according to the second embodiment has multiple coarse crystalline grains each having an aluminum matrix, and a dispersion material dispersed inside the aluminum matrix and formed by reacting a portion or all of an additive with aluminum in the aluminum matrix. Further, the composite material has multiple fine crystalline grains each having an aluminum matrix, and a dispersion material dispersed inside the aluminum matrix and formed by reacting a portion or all of an additive with aluminum in the aluminum matrix. Moreover, at least one of the purity of aluminum constituting the aluminum matrix and the content of the additive in the fine crystalline grains is different from that in the coarse crystalline grains. In addition, the fine crystalline grains exist among the coarse crystalline grains, and the crystalline grain diameters of the fine crystalline grains are smaller than the crystalline grain diameters of the coarse crystalline grains. In this configuration, since the dispersion material is highly dispersed inside the aluminum matrix of the fine crystalline grains, this makes it possible to form fine aluminum crystalline grains, and enhance the strength and the toughness of the aluminum-based composite material to levels equivalent to those of copper. Moreover, containing the coarse crystalline grains makes it possible to suppress a decrease in the electrical conductivity of the resulting aluminum-based composite material.

EXAMPLES

Hereinafter, the present invention will be described in more details by way of Examples and Comparative Example. However, the present invention is not limited to these Examples.

Example 1

First, an aluminum powder and a carbon nanotube were weighed such that the content of aluminum carbide serving as a dispersion material in fine crystalline grains to be obtained was 4.00% by mass. Note that the aluminum powder used was manufactured by Kojundo Chemical Lab. Co., Ltd. under the product name of ALE16PB, and had an average powder diameter of 20 μm. Moreover, the carbon nanotube used was manufactured by CNano Technology Limited under the product name Flotube 9000G2.

Next, the aluminum powder and the carbon nanotube thus weighed were introduced into a pot of a planetary ball mill and then rotated. Thereby, a fine crystalline grain precursor was prepared. Note that, as a result of observing the fine crystalline grain precursor in this event, the aluminum powder had a flat shape.

Further, the obtained fine crystalline grain precursor was mixed with a pure aluminum powder serving as a coarse crystalline grain precursor in a mass ratio of 1:1. Thereby, a powder mixture was prepared. Note that the pure aluminum powder used as the coarse crystalline grain precursor was manufactured by Koj undo Chemical Lab. Co., Ltd. under the product name of ALE06PB, and had powder diameters of 106 μm to 180 μm.

Next, the obtained powder mixture was introduced into a mold, and a pressure of 600 MPa was applied thereto at normal temperature to prepare a compact. Then, the obtained compact was heated in vacuum at 630° C. for 300 minutes using an electric furnace. Thereby, a sintered body of this example was prepared. Further, the obtained sintered body was extruded to obtain a drawn wire of this example having a diameter of 0.272 mm.

Example 2

First, an aluminum powder having a purity of 99.9% and a carbon nanotube were weighed such that the content of aluminum carbide serving as a dispersion material in fine crystalline grains to be obtained was 2.00% by mass. Note that the aluminum powder used was manufactured by Koj undo Chemical Lab. Co., Ltd., and had an average powder diameter of 20 μm. Moreover, the same carbon nanotube as that in Example 1 was used.

Next, the aluminum powder and the carbon nanotube thus weighed were introduced into a pot of a planetary ball mill and then rotated. Thereby, a fine crystalline grain precursor was prepared. Note that, as a result of observing the fine crystalline grain precursor in this event, the aluminum powder had a flat shape.

Further, an aluminum powder having a purity of 99.99% and a carbon nanotube were weighed such that the content of aluminum carbide serving as a dispersion material in coarse crystalline grains to be obtained was 2.00% by mass. Note that the aluminum powder used was manufactured by Koj undo Chemical Lab. Co., Ltd., and had an average powder diameter of 20 μm. Moreover, the same carbon nanotube as that in Example 1 was used.

Next, the aluminum powder and the carbon nanotube thus weighed were introduced into a pot of a planetary ball mill and then rotated. Thereby, a coarse crystalline grain precursor was prepared. Note that, as a result of observing the coarse crystalline grain precursor in this event, the aluminum powder had a flat shape.

Then, the obtained fine crystalline grain precursor and coarse crystalline grain precursor were mixed together in a mass ratio of 1:1. Thereby, a powder mixture was prepared.

Next, the obtained powder mixture was introduced into a mold, and a pressure of 600 MPa was applied thereto at normal temperature to prepare a compact. Then, the obtained compact was heated in vacuum at 630° C. for 300 minutes using an electric furnace. Thereby, a sintered body of this example was prepared. Further, the obtained sintered body was extruded to obtain a drawn wire of this example having a diameter of 0.272 mm.

Comparative Example

First, an aluminum powder and a carbon nanotube were weighed such that the content of aluminum carbide serving as a dispersion material in an aluminum-based composite material to be obtained was 2.00% by mass. Note that the same aluminum powder and carbon nanotube as those in Example 1 were used.

Next, the aluminum powder and the carbon nanotube thus weighed were introduced into a pot of a planetary ball mill and then rotated. Thereby, a powder mixture was prepared. Note that, as a result of observing the powder mixture in this event, the aluminum powder had a flat shape.

Then, the obtained powder mixture was introduced into a mold, and a pressure of 600 MPa was applied thereto at normal temperature to prepare a compact. Subsequently, the obtained compact was heated in vacuum at 630° C. for 300 minutes using an electric furnace. Thereby, a sintered body of this example was prepared. Thereafter, the obtained sintered body was extruded to obtain a drawn wire of this example having a diameter of 0.272 mm.

(Evaluation)

The drawn wires obtained in Examples 1 and 2 as well as Comparative Example were measured for the maximum tensile strength and elongation in accordance with JIS Z2241. Moreover, each of the drawn wires was measured for the electrical conductivity in accordance with JIS H0505. Table 1 shows the maximum tensile strength, elongation, and electrical conductivity of each drawn wire of Examples 1 and 2 as well as Comparative Example, together with the composition of the sample.

TABLE 1

| | Sample (φ 0.272 mm drawn wire, annealed material) | Maximum tensile strength (MPa) | Elongation (%) | Electrical conductivity (% IACS) |
|---|---|---|---|---|
| Example 1 | Al (powder diameter: 20 μm)/4.00 wt % $Al_4C_3$ composite material + pure aluminum powder (powder diameter: 106 to 180 μm) | 217 | 9.0 | 57.5 |
| Example 2 | Al with 99.9% purity (powder diameter: 20 μm)/2.00 wt % $Al_4C_3$ composite material + Al with 99.99% purity (powder diameter: 20 μm)/2.00 wt % $Al_4C_3$ composite material | 245 | 3.9 | 58.0 |
| Comparative Example | Al (powder diameter: 20 μm)/2.00 wt % $Al_4C_3$ composite material | 226 | 5.4 | 56.7 |

From Table 1, Example 1 according to the present embodiment was slightly inferior in tensile strength to Comparative Example, but made it possible to improve the elongation and the electrical conductivity. Moreover, Example 2 was slightly inferior in elongation to Comparative Example, but made it possible to improve the tensile strength and the electrical conductivity. In other words, although the content of aluminum carbide serving as the dispersion material is the same among the composite materials of Examples 1 and 2 as well as Comparative Example, the composite materials of Examples 1 and 2 each have a bimodal structure including the coarse crystalline grains and the fine crystalline grains. Hence, in comparison with the composite material of Comparative Example made of the fine crystalline grains, the composite materials of Examples 1 and 2 made it possible to improve at least one of the elongation and the electrical conductivity.

Figure 4:
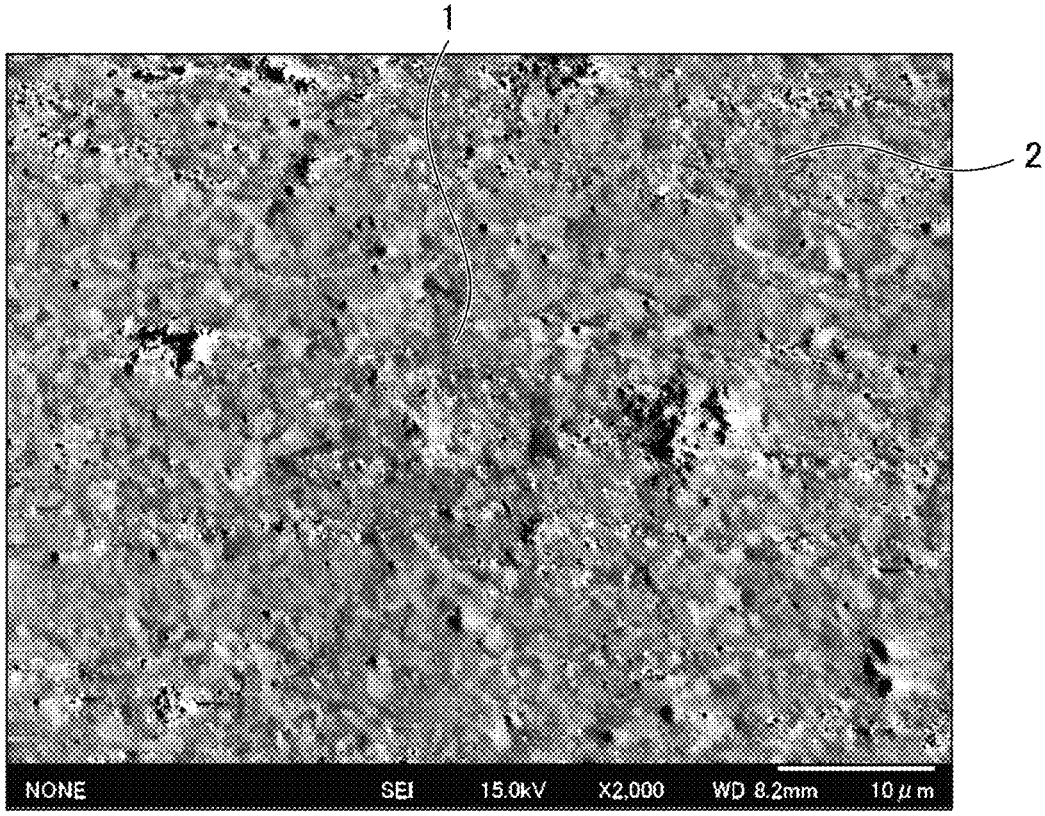
FIG. 4 is a scanning electron micrograph showing a cross section of a composite material (drawn wire) of Example 1.

FIG. 4 shows the result of observing a cross section of the drawn wire of Example 1 using a scanning electron microscope. FIG. 4 verifies that, in the composite material of Example 1, aluminum carbide particles are highly dispersed as a dispersion material 2 inside an aluminum matrix 1.

Figure 5:
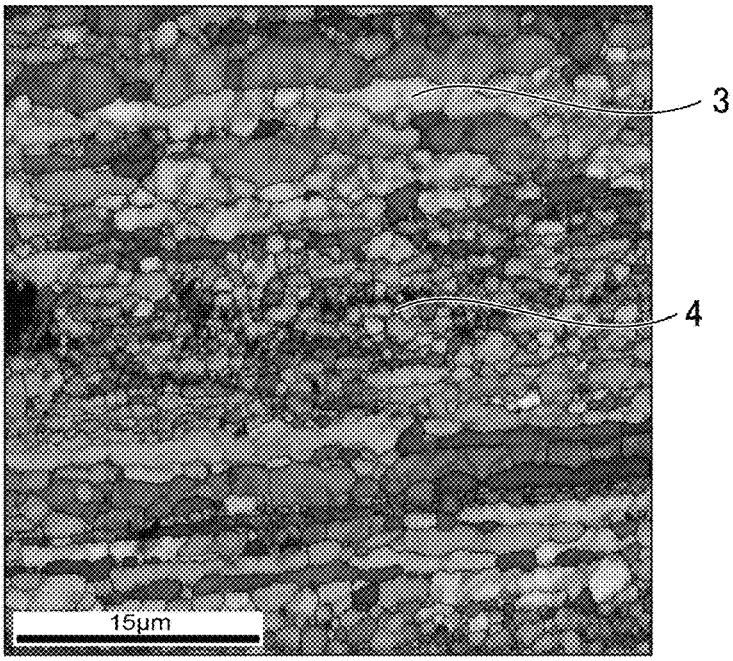
FIG. 5 is a photograph showing the result of examining a cross section of the composite material (drawn wire) of Example 1 by electron backscatter diffraction (EBSD).

Moreover, FIG. 5 shows the result of examining a crystalline grain boundary in a cross section of the drawn wire of Example 1 by electron backscatter diffraction (EBSD). FIG. 5 verifies that the composite material of Example 1 includes both the region of coarse crystalline grains 3 and the region of fine crystalline grains 4, and that the fine crystalline grains 4 exist among the coarse crystalline grains 3.

Hereinabove, the present invention has been described by way of Examples. However, the present invention is not limited thereto, and various modifications can be made within the gist of the present invention.

What is claimed is:

1. A method for manufacturing an aluminum-based composite material, the method comprising:

mixing an aluminum powder having a purity of 99% by mass or more with at least one additive selected from the group consisting of carbon nanotubes, carbon nanohorns, carbon blacks, boron carbides, and boron nitrides to form a first mixture milling the first mixture to obtain a fine crystal grain precursor;

mixing the fine crystal grain precursor with a coarse crystal grain precursor made of pure aluminum powder having a purity of 99% by mass or more to obtain a second mixture, compacting the second mixture to obtain a compact; and heating the compact at a temperature of 600 to 660° C. to obtain an aluminum-based composite material, wherein a shape of the aluminum powder in the fine crystal grain precursor is flat in which a ratio of a maximum major axis to a thickness of the aluminum powder is within a range of 10 or more and 100 or less.

2. The method for manufacturing the aluminum-based composite material according to claim 1, wherein the aluminum-based composite material comprises coarse crystal grains of aluminum and fine crystal grains of aluminum, the fine crystal grains of the aluminum-based composite material having (a) an aluminum matrix, and (b) a dispersion material dispersed inside the aluminum matrix and formed by reacting a portion or all of an additive with aluminum in the aluminum matrix during the heating of the compact, the fine crystal grains exist among the coarse crystal grains, the fine crystal grains have crystal grain diameters less than 1 μm, and the coarse crystal grains have crystal grain diameters of 1 μm to 5 μm.

3. The method for manufacturing the aluminum-based composite material according to claim 2, wherein a ratio of a long axis to a short axis (long axis/short axis) of the dispersion material is 1 to 30, the long axis ranges from 0.01 nm to 500 nm, and the short axis ranges from 0.01 nm to 200 nm.

4. The method for manufacturing the aluminum-based composite material according to claim 2, wherein a content of carbon in the dispersion material in the fine crystal grains is 0.1 to 2.0% by mass based on a total mass of the fine crystal grains.

5. The method for manufacturing the aluminum-based composite material according to claim 2, wherein a mass ratio of the coarse crystal grains to the fine crystal grains is 1:2 to 1:1.

* * * * *